US008672496B2

(12) United States Patent
O'Kane

(10) Patent No.: US 8,672,496 B2
(45) Date of Patent: Mar. 18, 2014

(54) SOCKET SUPPORTED DISCO MIRROR BALL

(76) Inventor: Mona O'Kane, Annapolis, MD (US)

( * ) Notice: Subject to any disclaimer, the term of this patent is extended or adjusted under 35 U.S.C. 154(b) by 82 days.

(21) Appl. No.: 13/452,262

(22) Filed: Apr. 20, 2012

(65) Prior Publication Data

US 2013/0107520 A1 May 2, 2013

Related U.S. Application Data

(60) Provisional application No. 61/477,348, filed on Apr. 20, 2011.

(51) Int. Cl.
*F21V 21/30* (2006.01)

(52) U.S. Cl.
USPC ..... 362/35; 362/235; 362/319; 362/346; 362/347; 362/350; 359/851; 359/876; 359/877; 40/431; 40/502

(58) Field of Classification Search
USPC ..... 362/235, 35, 86, 147, 319, 346, 347, 362/350; 359/837, 851, 876, 877; 40/431, 40/502
See application file for complete search history.

(56) References Cited

U.S. PATENT DOCUMENTS

| | | | | |
|---|---|---|---|---|
| 1,541,687 | A * | 6/1925 | Cory | 40/431 |
| 1,747,556 | A * | 2/1930 | Price | 40/431 |
| 4,250,537 | A * | 2/1981 | Roegner et al. | 362/86 |
| 5,035,623 | A * | 7/1991 | Coudurier et al. | 434/286 |
| 5,324,224 | A * | 6/1994 | Anderson et al. | 446/91 |
| 6,793,355 | B1 * | 9/2004 | Leung | 359/850 |
| 8,206,229 | B2 * | 6/2012 | Shimojo | 472/57 |

* cited by examiner

*Primary Examiner* — Ali Alavi
(74) *Attorney, Agent, or Firm* — Ober, Kaler, Grimes & Shriver; Royal W. Craig

(57) ABSTRACT

A mirror ball adapted to engage the socket of a ceiling mounted electric light fixture in order to be suspended and powered therefrom. A tubular stem having a proximal portion threaded in the manner of an Edision screw is provided extending downward from the fixture to a lower base. A lightweight mirrored sphere or globe having a void through its (vertical) polar axis is rotatably engaged on the stem and retained in place by the lower base which houses power systems, a controller and a motor engaged to an annular gear at the lower pole of the mirrored sphere in order to slowly rotate the globe. A power supply is used to reduce line voltage to 12 v DC to drive the motor and operate one or more LED lighting elements directed at the mirrored surface and mounted at the ends of one or more arms radiating from the lower housing.

1 Claim, 7 Drawing Sheets

SOCKET SUPPORTED DISCO MIRROR BALL

CROSS-REFERENCE TO RELATED APPLICATIONS

The present application claims priority to U.S. provisional patent application Ser. No. 61/477,348 filed 20 Apr. 2011, which is also incorporated herein by reference.

BACKGROUND OF THE INVENTION

1. Field of the Invention

The present invention relates to novelty lighting devices and more particularly to a lighting fixture suspended from an overhead bulb socket and having an internally motorized rotating mirror ball with stationery surrounding light sources to create a disco effect.

2. Description of the Background

The mirror ball is an iconic element of the "disco" era of the 1970's. Mirror balls were prominently featured over numerous dance floors at clubs such as Studio 54 in New York City as well as Brooklyn's fictional 2001 Odyssey, frequented by Tony Manero in 1977's Saturday Night Fever. The mirror ball's prominence in disco's led to it being popularly known as the disco ball although mirror balls date to at least the late nineteenth century. Written accounts of a Boston ballroom dance held in January of 1897 describe lighting displays that included "a carbon arc lamp flashing on a mirrored ball." Silent movies from the 1920's depict mirrored balls in use in clubs in Germany and they were common elements in establishments ranging from New York speakeasy's to New Orleans jazz clubs of that era. A mirror ball is even visible in background of the Moroccan nightclub in which much of the 1942 classic film Casablanca takes place.

The mirror ball itself is generally a spherical globe 6 to 18 inches in diameter having a series if individual mirrored elements affixed to its surface. The ball may be mounted on a base as a stationary objet d'art or, as is more common in later use, rotatably suspended from above as a lighting effect. When used as an objet d'art, ambient light is reflected from the various mirrored surfaces creating a gentle pattern of light about a room. As a lighting element in dimly lit clubs, and in particular in disco club, a focused beam of light is projected on the ball which is caused to rotate creating a pattern of individual beams/points of light that rotate about the room with the motion of the ball. In modern use the color or intensity of the light source may vary in with music.

After the disco era disco balls were relegated to novelty items but remain popular and have enjoyed something of a resurgence. Use of a disco ball in the home has been made possible by tabletop devices, or battery-powered motorized hanging balls (although the latter requires a hook or the like to be inserted into ceiling and, of course, the regular replacement of batteries). Damage to a ceiling is a concern when a mirror ball is regularly hung and removed as is the ability of the ceiling to support whatever hook or screw the user might use. Such home use devices also require setup of a separate light source.

It would be desirable to provide a mirror ball that can be easily and temporarily hung from an existing ceiling mounted lighting socket without the need to damage the ceiling.

It would further be desirable to provide a mirror ball with rotating mirror and integral light source, all drawing power from a conventional 120VAC light socket from which it is hung in order to avoid the need to replace batteries.

It would further be desirable to provide a mirror ball with motorized rotating mirror and stationery lighting source suspended from a single light socket.

It would further be desirable to provide a mirror ball that is light weight and easy and inexpensive to manufacture.

SUMMARY OF THE INVENTION

The present invention provides a mirror ball adapted to engage the socket of a ceiling mounted 120 VAC electric light fixture in order to be suspended and powered there from. A tubular stem having a proximal portion threaded in the manner of an Edison screw is provided extending downward from the fixture to a lower base. A lightweight mirrored sphere or globe having a void through its (vertical) polar axis is rotatably engaged on the stem and retained in place by the lower base which houses power systems, a controller and a motor engaged to an annular gear at the lower pole of the mirrored sphere in order to slowly rotate the globe. A power supply is used to reduce line voltage to 12 v DC to drive the motor and operate one or more LED lighting elements directed at the mirrored surface and mounted at the ends of one or more arms radiating from the lower housing.

DESCRIPTION OF THE DRAWINGS

The objects, features, and advantages of the present invention will become apparent from the following detailed description of the preferred embodiments and certain modifications thereof when taken together with the accompanying drawings in which like numbers represent like items throughout and in which.

DETAILED DESCRIPTION OF THE PREFERRED EMBODIMENT

Figure 1:
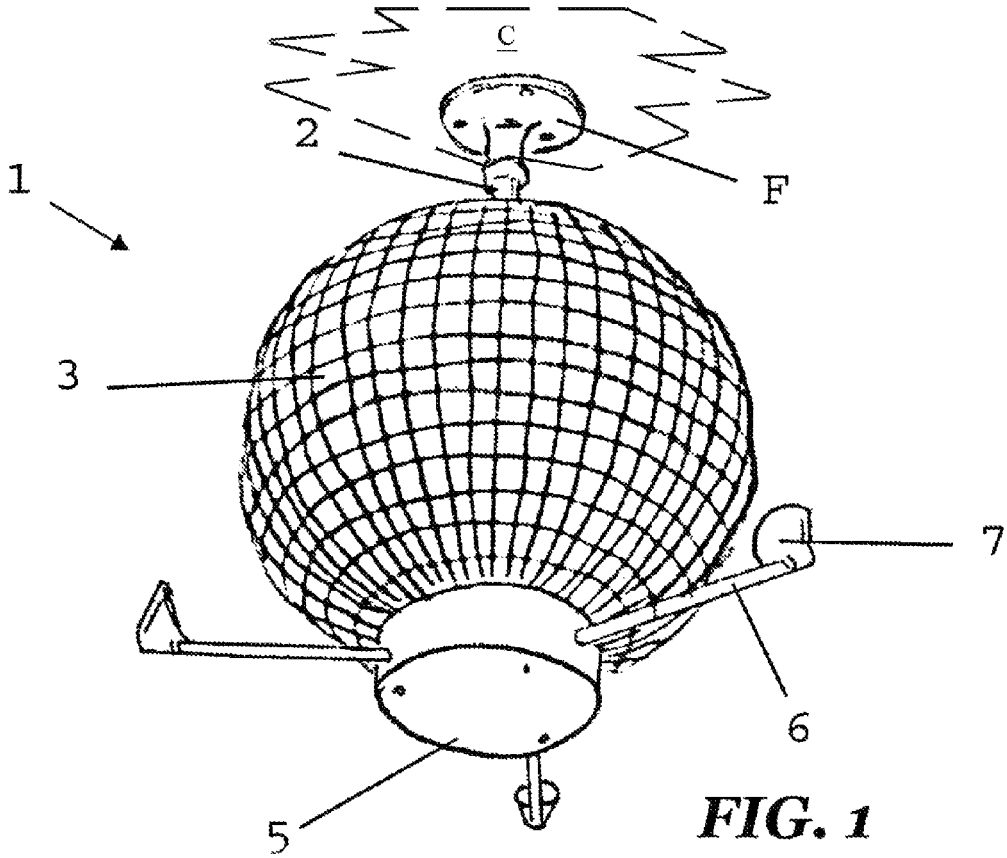
FIG. 1 is a perspective view from below of a mirror ball according to the present installed in a surface mounted light fixture.

For the purposes of promoting an understanding of the principles of the invention, reference will now be made to the exemplary embodiment illustrated in the drawings and described below. The embodiment disclosed is not intended to be exhaustive or limit the invention to the precise form disclosed in the following detailed description. Rather, the embodiment is chosen and described so that others skilled in the art may utilize its teachings. It will be understood that no limitation of the scope of the invention is thereby intended. The invention includes any alterations and modifications in the illustrated device, the methods of operation, and further applications of the principles of the invention which would normally occur to one skilled in the art to which the invention relates.

With reference to FIG. 1, a mirror ball 1 according to the present invention is affixed to a ceiling C by way engagement with an existing lighting fixture F. The mirror ball 1 engages the fixture F via a suspension stem 2, which suspends a rotating mirrored globe 3, a base housing 5 and series of lighting arms 6 protruding radially from base housing 5 and ending in a series of distal lights 7 directed back at the globe 3. The mirror ball 1 is configured to be supported by and to derive electrical power from a conventional socket for an Edison bulb screw fitting, and is thereby connected to the line current of the home by conventional electrical wiring. The preferred embodiment described herein is intended for use with 120 volt electrical service standard available in U.S. homes although a device according to the present invention can be practiced with other line voltages available according to other national standards.

Figure 6:
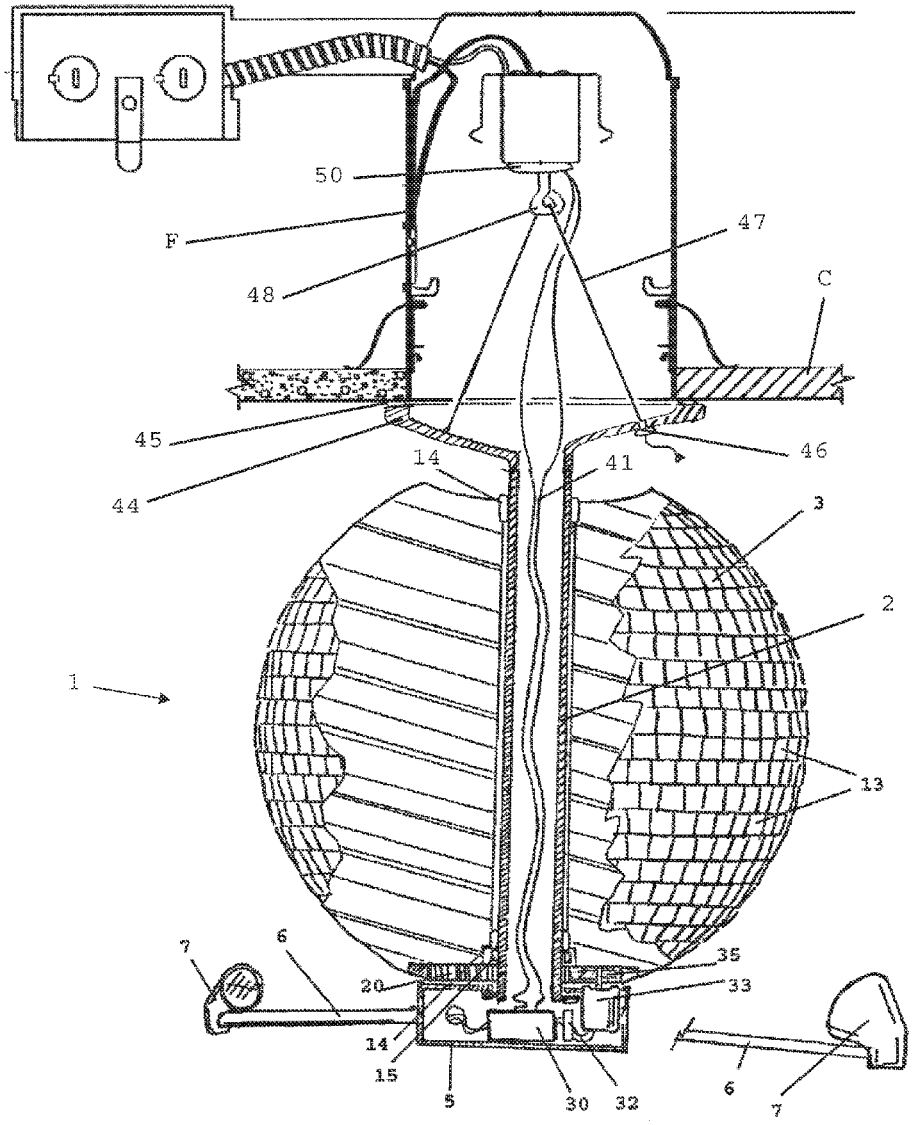
FIG. 6 a partial cutaway view of an alternate embodiment of a mirror ball according to the present invention for use with a recessed light fixture.

Fixture F may be a single bulb porcelain fixture commonly found in homes, basements, garages and other ceiling mounted locations but could be any electric light fixture with a suitable lamp socket including a recessed light fixture. An exemplary surface mounted light fixture as seen in FIG. 1 is the Leviton 29816-C—Pull Chain Porcelain fixture having a medium (E26) aluminum lamp socket base and rated to 250 v available from Leviton Manufacturing Company, Inc., Melville, N.Y. The fixture could, as noted, be any electric light fixture with a suitable lamp socket and may commonly be a recessed or "can" style light fixture as seen in FIG. 6 such as a Halo H7ICAT recessed downlight by Cooper Lighting of Peachtree City, Ga. which also provides a medium (E26) lamp socket. The Edison screw 26 mm socket base (E26) is the most common fixture used in American residential lighting and is the base found on common incandescent light bulbs in this country as well as on the compact fluorescent and LED lamps that are gradually replacing them. This fixture socket is right-hand-threaded for insertion of a bulb by clockwise rotation, and the threaded portion of the socket forms one of two electrical contacts. A second contact is formed in the bottom of the socket. It should be noted that while the preferred embodiment utilizes the E26 base, an alternate fixture for receiving an Edison bulb screw and compatible with the conventions of a country or region may be utilized in accordance with the present invention.

Fixture F of the Leviton pull chain porcelain type is typically installed in a 3¼ or 4 inch ceiling mounted electrical box according to the electrical code requirements of the jurisdiction, commonly the National Electrical Code (NEC) as promulgated by the National Electrical Manufacturers Association. The NEC requires that electrical boxes serving outlets used for lighting be designed so that the luminaire (i.e. fixture) may be installed to the box. Metallic and non-metallic 4 inch (100 mm) round or square boxes such as are typically used for fixtures such as the 29816-C are presumed to be capable of supporting up to 50 lbs (23 kg) under the code and are more than capable of supporting the mirror ball 1 according to the present invention when installed in a code complaint electric light fixture F. Where fixture F is of the recessed type, several mounting scenarios are possible and care should be taken to ensure that the fixture is capable of supporting the mirror ball. It is further noted that certain embodiments of the invention may be invertible so as to be mounted into the socket of table lamp or similar fixture with the shade removed.

Figure 2:
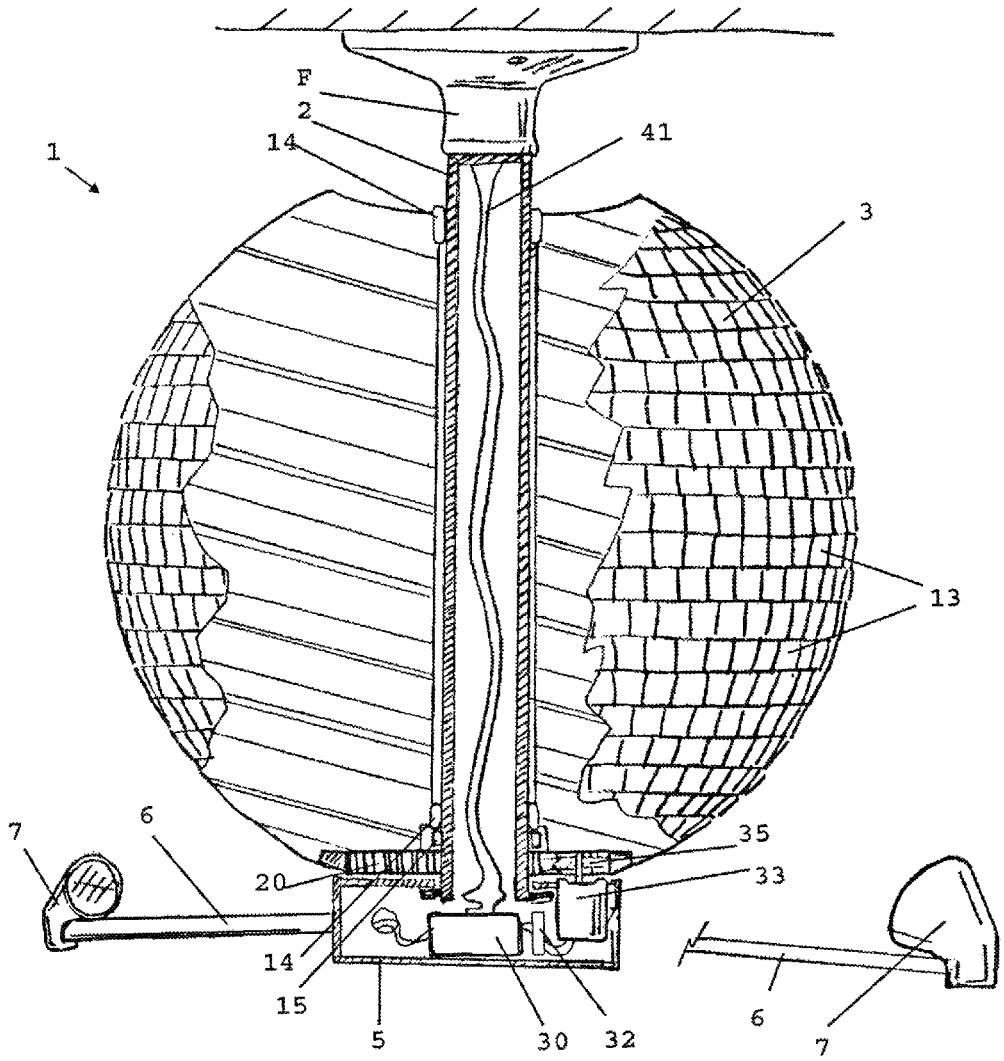
FIG. 2 is a partial cutaway view of a mirror ball according to the present.
Figure 4:
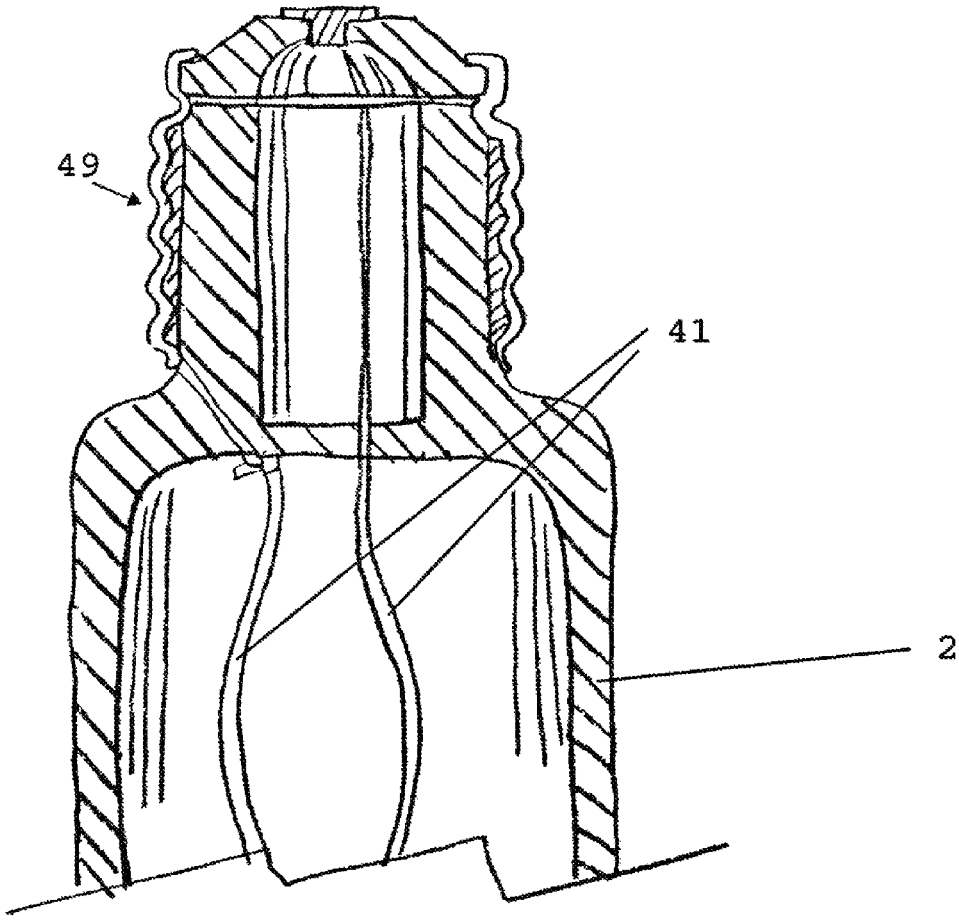
FIG. 4 is a partial detail view of the stem at the Edison screw.
Figure 5:
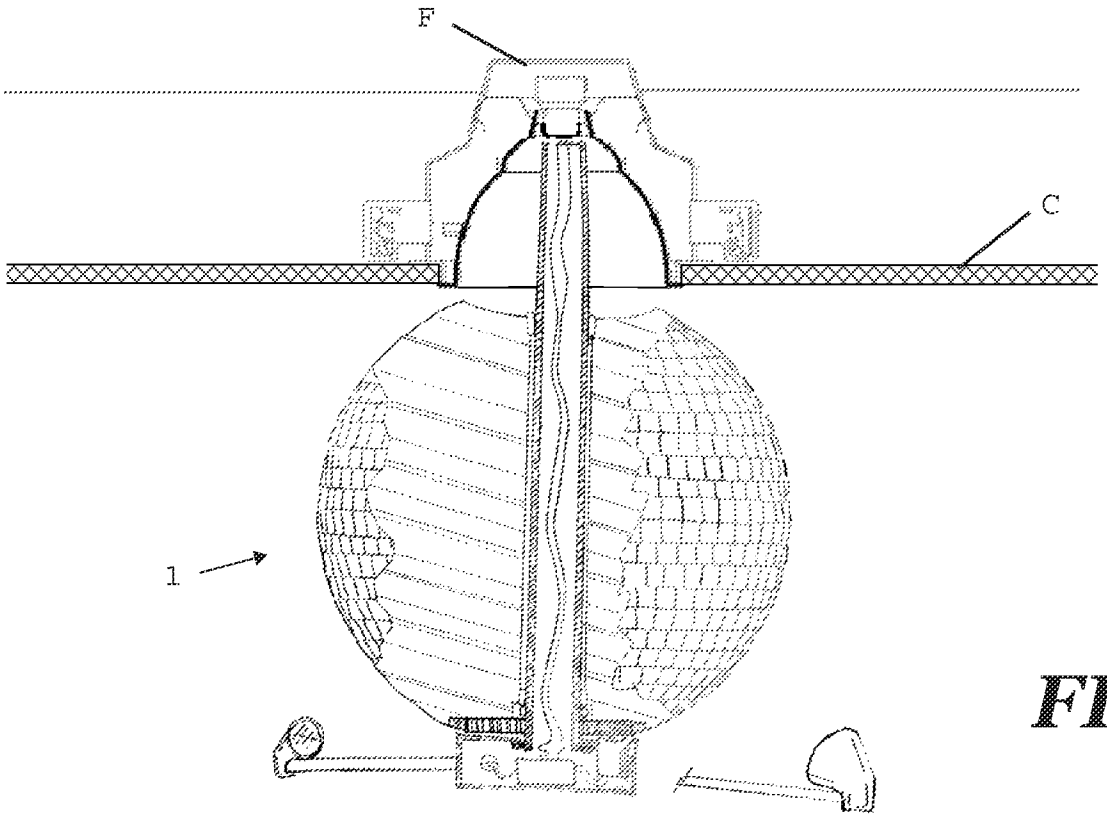
FIG. 5 is a partial cutaway view of an alternate embodiment of a mirror ball according to the present invention for use with a recessed light fixture.

With reference to FIGS. 2 and 4, a mirror ball 1 is depicted engaged to a surface mounted fixture F at stem 2. Stem 2 is a tubular member having an E26 Edison base 49 at its proximal end of engagement with the lamp socket base of the fixture as described. The "drop" or length of the stem 2 between the socket base and the top of the mirror ball is preferably long enough so that the mirror ball hangs below and is clear of the surface of the ceiling which is not an issue where the fixture F is surface mounted. Where use with a recessed light fixture is anticipated as seen in FIG. 5, the stem 2 may be formed of sufficient length to be received within the socket while providing sufficient drop for the mirror ball to clear the ceiling. In an alternate embodiment, a removable adaptor or socket extension may be provided to adjust the stem length to accommodate both surface and recessed fixtures. Stem 2 is preferably circular in cross section and extends downward from its proximal end to the base housing 5. Stem 2 and base housing 5 are preferably made from a strong, light weight electrically insulative material such as Acrylonitrile butadiene styrene (ABS) which may be injection molded during the manufacturing process. Those skilled in the art will recognize that a wide variety of suitable lightweight plastic materials are available.

A globe 3 is provided coaxial with the stem 2 and rotatably mounted for rotation about the stem which forms a journal for the globe. Globe 3 is preferably hollow with an upper distal aperture and lower distal aperture formed to receive the stem 2 through globe 3. The globe 3 is supported for rotation bout the stem 2 by thermoplastic bushings 14, preferably nylon, affixed to the globe 3 in the upper/lower apertures at the poles. A locking C-clamp or nut 15 is provided encircling the lower distal end of the stem 2 and against which the lower bushing 14 can bear to prevent the globe 3 from slipping vertically downward. The locking C-clamp/nut 15 may be replaced by a step increase in the diameter of the stem 2. In addition, a second clip or nut (not shown) 15 may be provided at the opposing end (top pole) of the stem to fully retain the globe 3 on the stem 2 when not mounted in the fixture F. The proximal clip or nut (not shown) also provides a surface against which the upper bushing may bear if the mirror ball 1 I inverted for mounting in a table lamp.

The globe 3 is preferably spherical or near spherical and is covered on its external surface with individual segmented mirrors or like reflective elements, which thereby form the iconic disco mirror ball. The globe 3 is preferably a hollow sphere formed with spherical plastic walls, with a central tubular member for receiving the stem 2, and segmented mirrors attached exteriorly. Alternatively, globe 3 may be solid and formed from expanded polystyrene foam (i.e. Styrofoam™) which is lightweight and relatively strong. Those skilled in the art will recognize that the globe may be constructed of other lightweight materials as a matter of design choice.

Figure 3:
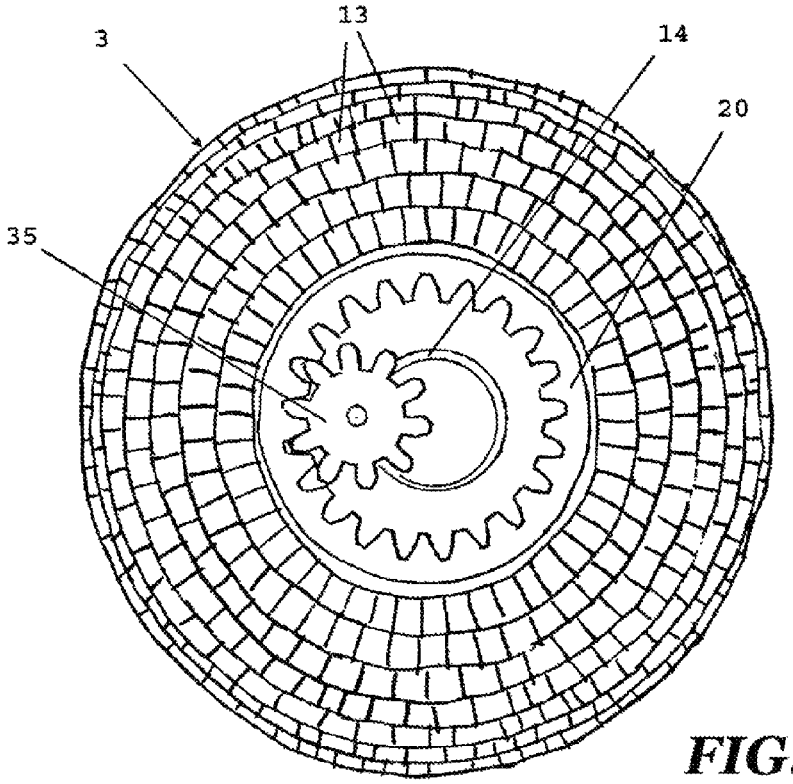
FIG. 3 is a bottom view of the mirrored globe 3 removed from the stem.

With continued reference to FIG. 2 and additional reference to FIG. 3, the globe 3 is made to rotate about stem 2 by a ring gear or annular gear 20 provided at the lower pole of the globe 3. Annular gear 20 is preferably formed of a lightweight thermoplastic material and is bonded or mechanically affixed within a circular recess prepared within the surface of the globe.

A thermoplastic base housing 5 is affixed to the distal end of the stem 2 contains the motor drive and control elements for the globe 3 and lights 7 as will be described below. The housing 5 is preferably a cylindrical enclosure coaxially oriented with the stem 2 and globe 3. The lower surface of the housing 5 may be removable in order to access the contents of the housing, which include a power supply/converter 30, controller 32 and motor 33. The power supply/converter is preferably a 12 volt DC power supply for converting the 120 volt AC line power received from the lighting fixture via wires 41 to a more suitable level for the present invention. Those skilled in the art will recognize that 6 volts or 24 volt power converters are readily available and would provide suitable power supplies for the present invention.

A DC electric motor 33 is connected to the power supply 30 by way of a motor control circuit 32 that, at its simplest, may provide on-off control of motor operation via an external on-off power switch (not pictured). In an alternate embodiment, the motor control circuit 32 may provide additional power modulation to, for example, provide variable speed control over the operation of the motor via, for example, an external speed selection switch (not pictured). The motor 33 is mounted within the housing 35 with its drive shaft extending through the upper surface of the housing and terminating in a pinion gear 35. With reference to FIG. 3, the pinion 35 engages the annular gear 20 in order to cause the globe 3 to rotate about the stem 2 when the motor is energized. It is preferred that the globe rotate at a rate of 3 to 10 RPM. It is further preferred that the globe 3 rotate in a counterclockwise direction (as viewed from below). Counterclockwise rotation of the globe imparts a clockwise reactionary moment on the housing 5 which is imparted on the Edison screw connection at the fixture F via the stem 2. A clockwise rotation of the stem in the fixture will tend to tighten the engagement of the stem in the socket, further securing the connection. Rotation of the globe 3 in the opposite direction would tend to cause counterclockwise rotation of the mirror ball 1 in the fixture socket and increase the risk that the mirror ball would fall from the fixture F. One skilled in the art will readily understand that the annular gear 20 may be eliminated by use of a direct-drive motor employing a stationary inner core or "stator" with a rotor that revolves around it (commonly called a "spinner" or "pancake" motor), and the globe 3 may be attached directly to the rotor. Direct-drive motors are inexpensive but somewhat more prone to failure and noise. A direct drive motor is considered to be within the scope and spirit of the present invention.

One or more light sources 7 are provided at the distal ends of arms 6 extending radially from the housing 5. Three arms 6 are preferred such that the arms are regularly spaces at 120 degree intervals about the circular housing 5 although a greater or fewer number may be selected. The arms 6 are tubular members each terminating at their distal ends in a light source 7. The light source 7 preferably includes one or more high intensity 12 volt LED lamps powered by the power source 30 via the controller 32 and wires routed through the tubular arms 6. In a preferred embodiment, each light source 7 contains multiple LED lamps in a variety of colors including white that can be switched on or off by the controller 32 to vary the lighting effect. A reflector and lens may be provided in the light source 7 in order to focus the light produced by the one or more LED lamps on the globe 3. One skilled in the art will recognize that other light sources may be appropriately selected such as MR16 or MR11 12 volt AC lamps. Such lamps provide higher intensity white light but also significantly more heat and would require additional electrical power conversion. Line voltage reflector bulbs such as PAR 16 lamps could also be used albeit with more limited operation lighting control. Static lens gels could be used to color the light in either embodiment.

In another alternate embodiment, the controller 32 may also include an RF receiver for power, speed and/or lighting control by remote control when the mirror ball 1 is mounted at a height at which external control switches would be unreachable from the ground. Such a controller could allow a user on the ground to control rotational speed (including stop/off), light color, and light intensity.

In yet another alternate embodiment, controller 32 may incorporate a microphone for sampling ambient audio in order for the controller to alter the light color, light frequency and/or globe rotational speed as a function of ambient sound conditions (i.e. music). For example, the controller could flash the light color in synchronization with the speed of music being played in the space.

Figure 8:
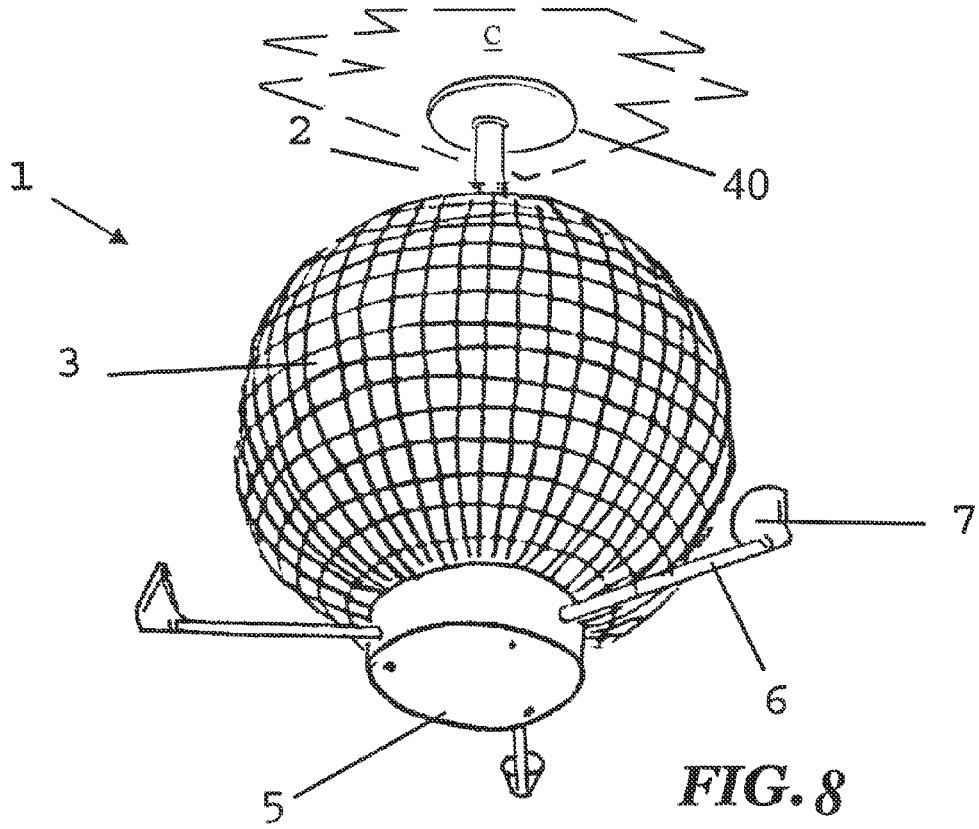
FIG. 8 is a perspective view from below of a mirror ball according to the present installed in a recessed light fixture.

With reference to FIG. 5, an alternative means for mounting the suspension stem 2 may preferably used in conjunction with a recessed light fixture such as the above identified Halo product. The suspension stem 2 is elongated to a sufficient length to engage the socket of a recessed fixture F above the level of the ceiling C while permitting the globe 3 to hang below the ceiling level. A cover 40 (See FIG. 8) may be slideably provided on the suspension stem 2 that may be advanced upward against the ceiling C to cover the unsightly opening of the recessed fixture F. The cover will understandably be sized to cover an opening up to six inches in diameter (or more) corresponding to the largest aperture size available in residential recessed fixtures. The upper surface of the cover may also be provided with an area of high friction elastomeric material such as rubber. The high friction material is preferably positioned at the periphery of the cover so as to engage the surface of the ceiling C and resist counter rotation of the device 1.

Figure 7:
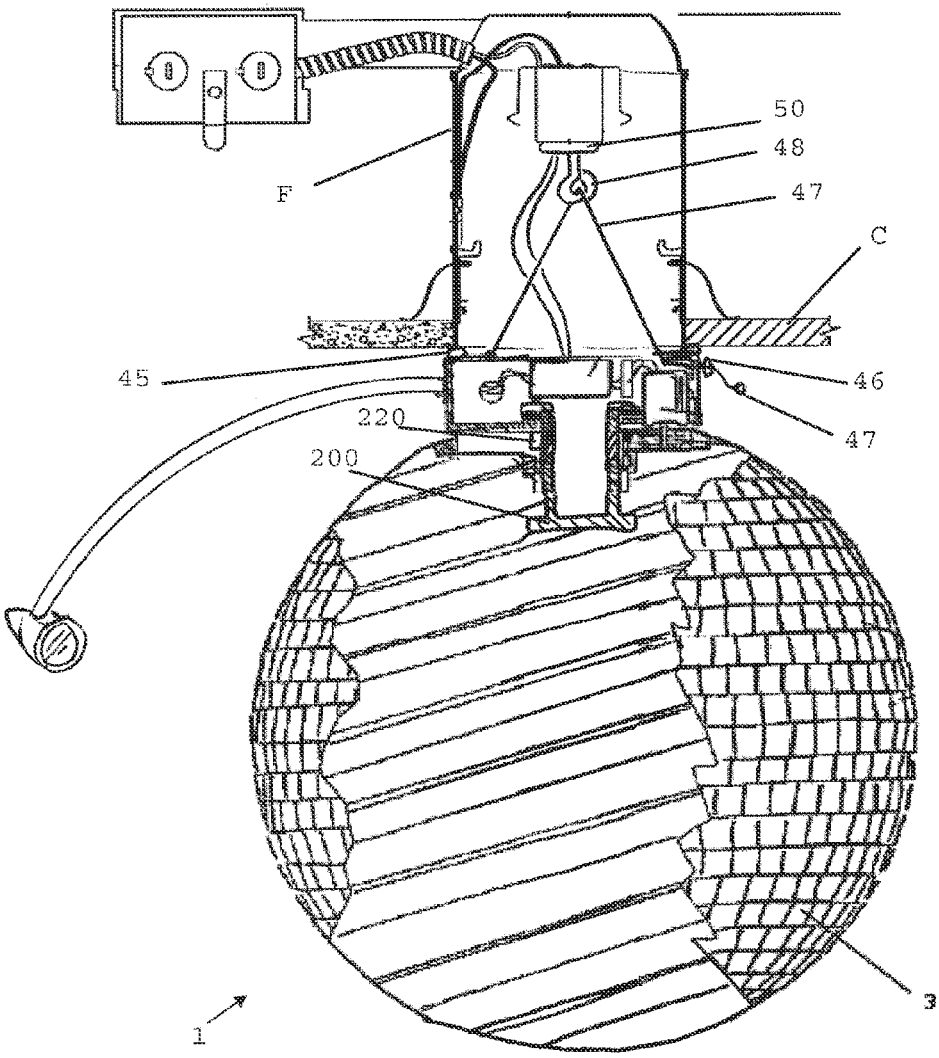
FIG. 7 a partial cutaway view of an alternate embodiment of a mirror ball according to the present invention for use with a recessed light fixture.

With reference to FIGS. 6 and 7, yet another embodiment of the present invention optimized for use with a recessed light fixture is disclosed. With specific reference initially to FIG. 6, the suspension stem 2 is formed at its upper end with an integral cover 44 which is sized, as above, to cover the unsightly opening of the recessed light fixture. A high friction elastomeric surface 45 is provided on the top side at the periphery of the cover 44 where the cover engages the ceiling 4 to resist rotation of the stem 2 and housing 5 in reaction to rotation of the globe 3. A lamp base 50 is provided for threaded insertion to the socket of the recessed fixture. Power wires 41 are energized via connection with the base 50. Also engaged to the base 50 is a hook or eye 48. A cord 47 is engaged to the inside of the cover 44 and looped through the eye 48 before returning to and passing through a hole in the cover. A stop 46 is slideably and releasably engaged to the cord 47. To install the mirror ball 1 the stop 46 is moved the distal end of the cord 47 such that there considerable extra cord length above the cover 44. The base 50 is then threaded into the socket. After the base 50 is secured in the socket the cord 47 is pulled through the cover 44 and the stop advanced up the cord to engage the outside surface of the cover. The cord 47 is preferably somewhat elastic so that the cord can be tensioned to maintain the cover 44 in secure engagement with the ceiling C. The stop 46 maintains the cord tension until it is desired to remove the mirror ball 1 at which point the stop is released and the installation process reversed. The cord 47 may be hooked to a tab or other existing internal protrusion (not claimed) within the fixture F to temporarily suspend the mirror hall 1 so as to free the installers hands to insert the lamp base 50. Alternately, for ease of installation the cover 44 may be a separate element from the stem 2 having at the point of transition to the tubular portion of the stem a socket receiving a cooperative upper end of the tubular portion of the stem 2. The socket would likewise contain a breakable power connection so that the wires 41 need not be continuous and the upper portion (above the cover 44) may be installed while the globe 3, housing 5 and lights 7 remain on the ground to be installed after the socket 50 and cover 44 are in place.

With reference to FIG. 7, yet another alternate embodiment optimized for use with a recessed light fixture. In the embodiment of FIG. 7, the housing 5 is located above the globe 3 and serves the additional purpose of covering the unsightly aperture of the recessed fixture. As in the previous embodiment a high friction elastomer 45 is provided between the housing 5 and the ceiling C to resist the reactionary force. A socket 50 having an eye 48 is provided through which a cord 47 is tensioned, the tension being maintained by a stop 46 external to the housing 5. The suspension stem 200 is here truncated and fixed within the globe 3. The suspension stem 200 is rotatably received within and suspended from the housing 5. The external surface of the suspension stem 200 is provided with annular teeth engaged by the pinion 35 to drive rotation of the globe. The globe and stem 200 may preferably be releasably and rotatably received in the housing 5 such that the socket 50, housing 5 and lights 7 can be installed in the fixture F without the bulk of the globe in place, the stem 200 being inserted into the housing and engaged to the pinion 35 after installation in the fixture F.

With all the above-described embodiments, it should be apparent that the invention provides an iconic self-lighted rotating disco ball suitable for use in the home and without the effort or damage to a ceiling needed to install a commercial fixture. The present mirror ball can be easily and temporarily hung from any existing ceiling mounted lighting socket, draw power from a conventional 120V AC line, and is light weight and easy and inexpensive to manufacture.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims and may be used with a variety of materials and components. This application is therefore intended to cover any variations, uses, or adaptations of the invention using its general principles. Further, this application is intended to cover such departures from the present disclosure as come within known or customary practice in the art to which this invention pertains.

I claim:

1. A mirror ball adapted to engage the socket of a ceiling mounted lighting fixture, comprising a tubular stem having a proximal end for engaging said socket and a distal end, said proximal end having a threaded portion for mechanical and electrical engagement with said socket, a spherical globe, said globe comprising an external surface having a plurality of reflective elements, a central void through said sphere along a vertical axis, said void sized to receive said stem such that said globe is rotatable thereon, and an annular gear affixed to an end of said sphere and coaxial with said void, a housing affixed to said distal end of said stem, said housing further containing a power converter electrically connected to said threaded portion, a controller electrically connected to said power supply, and a motor electrically connected to said controller, said motor further comprising a shaft mounted pinion extending through a wall of said housing to engage said annular gear, and at least one arm extending from said housing, said arm further comprising at least one lamp directed to illuminate said reflective elements.

* * * * *